United States Patent [19]

Johannes

[11] 4,053,142

[45] Oct. 11, 1977

[54] NONMECHANICAL SHEARING MIXER

[75] Inventor: Walter Johannes, Rochester, N.Y.

[73] Assignee: Eastman Kodak Company, Rochester, N.Y.

[21] Appl. No.: 695,272

[22] Filed: June 11, 1976

[51] Int. Cl.[2] ..... B01F 15/02

[52] U.S. Cl. ..... 366/165

[58] Field of Search ..... 259/4 R, 4 A, 4 AB, 259/4 AC, 18, 36; 431/134, 182

[56] References Cited

U.S. PATENT DOCUMENTS

| | | | |
|---|---|---|---|
| 2,653,801 | 9/1953 | Fontein | 254/4 R |
| 3,147,955 | 9/1964 | Harvey | 259/4 R |
| 3,164,443 | 1/1965 | Watson | 259/4 R |
| 3,261,593 | 7/1966 | Sharples | 259/4 R |
| 3,402,916 | 9/1968 | Kates | 259/4 R |

*Primary Examiner*—Robert W. Jenkins
*Attorney, Agent, or Firm*—S. W. Gremban

[57] ABSTRACT

A nonmechanical shearing mixer uses fluid velocity to create sufficient turbulence to completely mix two fluid components. Mixing is accomplished in an annular mixing chamber defined by inner and outer cylindrical walls. A first fluid is forced under pressure outwardly through openings in the inner cylindrical wall, the openings being oriented and arranged to cause the first fluid passing therethrough to undergo a generally rotational fluid flow pattern in the annular mixing chamber. A second fluid entering the annular mixing chamber through openings in the outer cylindrical wall is similarly caused to undergo a generally rotational fluid flow pattern but in the opposite direction of the rotational fluid flow pattern of the first fluid. The two opposing rotational fluid flow patterns thus "clash" in the annular mixing chamber and create a large amount of turbulence and shearing action resulting in effective and complete mixing of the two fluids. The mixed fluid components are continuously discharged from the annular mixing chamber.

3 Claims, 2 Drawing Figures

NONMECHANICAL SHEARING MIXER

BACKGROUND OF THE INVENTION

1. Field of the Invention

The present invention relates to mixing apparatus having no moving parts for mixing fluids, and in particular to mixing apparatus using fluid velocity to create sufficient turbulence to completely mix two fluid components.

2. Description of the Prior Art

Fluid mixing apparatus having no moving parts are generally known in the art. U.S. Pat. No. 3,402,916 discloses a fluid mixing device wherein all fluids to be mixed enter through a common inlet tube and are discharged into a mixing chamber through a first and second plurality of ports in the tube. The ports are arranged to produce tangential shear planes in the fluid to cause the fluid to become intermixed. A discharge opening is also provided in the inlet tube which allows a portion of the fluid to discharge directly to an outlet tube for purposes of reducing pressure drop across the mixing device. For such a mixer, however, at least some premixing must be performed since both fluids enter through a common inlet tube. And if the pre-mixing is not somewhat thorough, the possibility exists that fluid discharged from the discharge opening (the opening in the inlet tube connecting directly to the outlet tube for purposes of pressure drop reduction) will be poorly mixed.

U.S. Pat. No. 2,653,801 discloses apparatus suitable for use in mixing two liquid components wherein a liquid enters a chamber from which it is forced under pressure through a series of slots. The slots are arranged to produce a cyclonic current in which a second liquid is added at or near the center of the cyclonic current for mixing therewith. Since only one of the liquid components undergoes a cyclonic flow pattern, the "passive" liquid added to the vortex readily flows with the rotating liquid, thereby reducing mixing effectiveness.

U.S. Pat. No. 3,261,593 discloses fluid mixing apparatus wherein a first liquid enters a first cylindrical chamber through a first tangential inlet tube, the first liquid thus creating a swirling vortex in the first chamber. Similarly, a second fluid is fed through a second tangential inlet tube to a second cylindrical chamber and assumes a vortical fluid flow pattern therein. The first and second liquids pass in swirling movement through a pair of respective nozzles into a common mixing chamber from which they are discharged as a single mixed liquid through an outlet tube. The common mixing chamber, where a substantial amount of mixing occurs, is relatively small and the liquids readily pass through it to a larger output chamber. Once in the output chamber, the turbulence quickly dies out and mixing is much less effective.

While all of the prior art mixing devices are suitable for mixing some fluids, there are other fluids which are less miscible and, therefore, more difficult to mix effectively.

SUMMARY OF THE INVENTION

In accordance with the present invention, mixing apparatus is provided for effectively and completely mixing two fluid components. Mixing apparatus in accordance with the invention comprises means defining a generally annular mixing chamber wherein the mixing of first and second fluid components takes place. Means are provided for causing the first fluid to enter said mixing chamber and to assume a generally rotational fluid flow pattern. Means are further provided for causing the second fluid component to enter said mixing chamber and also assume a generally rotational fluid flow pattern, but in a direction opposite that of the first fluid component. The opposing rotational fluid flows "clash", thereby producing sufficient and proper turbulence for the complete mixing of the first and second fluid components. As the first and second fluid components enter said mixing chamber, mixed fluid is discharged therefrom.

BRIEF DESCRIPTION OF THE DRAWING

In the detailed description of the preferred embodiments of the invention presented below, reference is made to the accompanying drawings in which.

DESCRIPTION OF THE PREFERRED EMBODIMENTS

Because fluid handling apparatus are well known, the present description will be directed to elements forming part of, or cooperating more directly with, apparatus in accordance with the present invention. Elements of fluid handling apparatus not specifically shown or described should be understood to be selectable from those known in the art.

Figure 1:
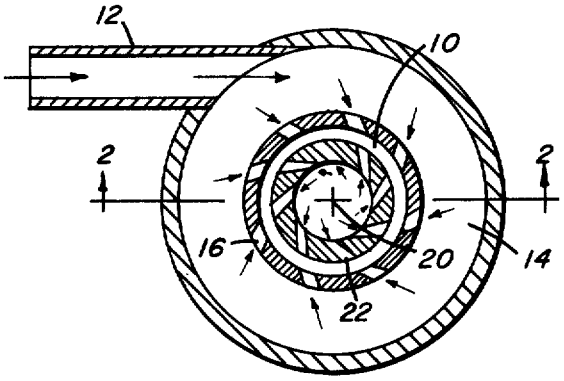
FIG. 1 is a sectional view taken substantially along line 1—1 of FIG. 2 of a mixing device in accordance with the invention.
Figure 2:
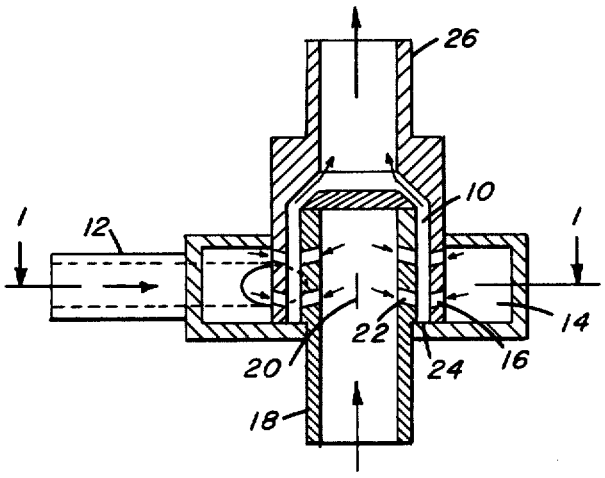
FIG. 2 is a sectional view taken substantially along line 2—2 of the mixing device shown in FIG. 1.

FIGS. 1 and 2 are section views respectively of a presently preferred embodiment of the invention. In the fluid mixing device shown, two fluid components are effectively and completely mixed by turbulence created in an annular mixing chamber 10. A first fluid component is supplied under pressure to a first inlet tube 12 from which the first fluid passes into an annular outer chamber 14. As the outer chamber 14 becomes filled with fluid, the first fluid is forced through a first series of ports 16. The ports 16 are so oriented and arranged as to cause the first fluid to assume a generally clockwise (as seen from FIG. 1) rotational fluid flow pattern in the annular mixing chamber 10. A second fluid is fed under pressure through a second inlet port 18 to a cylindrical inner chamber 20. As the inner chamber 20 fills with fluid, the second fluid is forced through a second series of ports 22 oriented and arranged so as to cause the second fluid to flow in a generally counter-clockwise (as seen from FIG. 1) fluid flow pattern in the annular mixing chamber 10.

In the annular mixing chamber 10, therefore, the rotational fluid flow patterns of the first and second fluid components (clockwise and counter-clockwise respectively) crash head on and create a tremendous amount of shearing turbulence. This turbulence is further increased by orienting the ports 16 and 22 as shown in FIG. 2, thereby tending to cause the fluid components in the annular mixing chamber to initially flow towards the bottom portion 24 of the mixing chamber 10 before being discharged from the top portion of the mixing chamber 10 through an outlet tube 26. The turbulence thus created is sufficient to thoroughly mix the first and second fluid components. As stated, the fluid mixture is discharged from the fluid mixing device through an outlet tube 26.

While the fluid mixing device described above is totally adequate for thoroughly mixing most fluid components, for some applications it may be desirable to operate several of the described mixing devices in series. For example, the mixed fluid discharged from the outlet tube 26 may be separated into two portions which are then supplied to the first and second inlet tubes 12 and 18 respectively of another generally identical mixing device for another stage of mixing.

The invention has been described in detail with particular reference to preferred embodiments thereof, but it will be understood that variations and modifications can be effected within the spirit and scope of the invention.

What is claimed is:

1. Apparatus for mixing first and second fluid components, said apparatus comprising;

a. means defining an outer chamber into which the first fluid is supplied under pressure;

b. means defining an inner chamber into which the second fluid is supplied under pressure;

c. means defining an annular mixing chamber interposed between said inner and outer chambers, said annular mixing chamber having a first and second series of ports therein to said outer and inner chambers respectively, said first series of ports so oriented that the first fluid flowing therethrough from said outer chamber to said annular mixing chamber assumes a generally rotational fluid flow pattern in said annular mixing chamber, said second series of ports so oriented that the second fluid flowing therethrough from said inner chamber to said annular mixing chamber assumes a generally rotational fluid flow pattern in said annular mixing chamber but in a direction generally opposite that of said first fluid rotational fluid flow pattern; and d. means for discharging fluid from said annular mixing chamber.

2. Apparatus as claimed in claim 1 wherein said first and second series of ports are arranged to direct the first and second fluids respectively passing therethrough in a direction away from said discharge means.

3. Apparatus as claimed in claim 1 wherein said inner chamber is a generally cylindrical chamber and said outer chamber is a generally annular chamber, said annular mixing chamber being concentric about said cylindrical inner chamber and said annular mixing chamber being concentric within said annular outer chamber.

* * * * *